US010752982B2

(12) United States Patent
Schwander et al.

(10) Patent No.: US 10,752,982 B2
(45) Date of Patent: Aug. 25, 2020

(54) INSTALLATION FOR HOT DIP COATING A METAL STRIP COMPRISING AN ADJUSTABLE CONFINEMENT BOX

(71) Applicant: ArcelorMittal, Luxembourg (LU)

(72) Inventors: Peter Schwander, Bremen (DE); Axel Wendt, Bremen (DE); Andreas Steffen, Bremen (DE); Hubert St Raymond, Metz (FR); Maxime Monnoyer, Sainte Marie Aux Chenes (BE); Julien Benoit, Metz (FR); Jean Michel Mataigne, Senlis (FR); Paul Durighello, Thionville (FR)

(73) Assignee: ARCELORMITTAL, Luxembourg (LU)

( * ) Notice: Subject to any disclaimer, the term of this patent is extended or adjusted under 35 U.S.C. 154(b) by 526 days.

(21) Appl. No.: 14/895,985

(22) PCT Filed: Jun. 10, 2014

(86) PCT No.: PCT/IB2014/062092

§ 371 (c)(1),
(2) Date: Dec. 4, 2015

(87) PCT Pub. No.: WO2014/199292

PCT Pub. Date: Dec. 18, 2014

(65) Prior Publication Data

US 2016/0122854 A1 May 5, 2016

(30) Foreign Application Priority Data

Jun. 10, 2013 (WO) ..... PCT/IB2013/054750

(51) Int. Cl.
*C23C 2/06* (2006.01)
*C23C 2/00* (2006.01)
(Continued)

(52) U.S. Cl.
CPC ..... *C23C 2/06* (2013.01); *C22C 18/00* (2013.01); *C22C 18/04* (2013.01); *C23C 2/003* (2013.01);
(Continued)

(58) Field of Classification Search
CPC ..... C23C 2/14; C23C 2/16; C23C 2/20
See application file for complete search history.

(56) References Cited

U.S. PATENT DOCUMENTS 4,310,572 A * 1/1982 Stavros ..... C23C 2/06 118/422
4,330,574 A 5/1982 Pierson et al.
(Continued)

FOREIGN PATENT DOCUMENTS

CN 1283708 A 2/2001
CN 201737996 U 2/2011
(Continued)

*Primary Examiner* — Dah-Wei D. Yuan
*Assistant Examiner* — Stephen A Kitt
(74) *Attorney, Agent, or Firm* — Davidson, Davidson & Kappel, LLC

(57) ABSTRACT

An installation for hot dip coating a metal strip is provided. The installation includes a device for moving the metal strip along a path, a pot for containing a melt bath and a wiping system including at least two nozzles placed on either side of the path downstream the pot. The wiping system has a box with a lower confinement part confining an atmosphere around the metal strip upstream of said nozzles and an upper confinement part confining the atmosphere around the metal strip downstream of the nozzles, first moving means for vertically moving the lower confinement part with respect to the pot and second moving means for vertically moving the upper confinement part with respect to both the pot and the lower confinement part. The nozzles are vertically movable relative to the pot.

21 Claims, 3 Drawing Sheets

(51) Int. Cl.

| | |
|---|---|
| ***C23C 2/20*** | (2006.01) |
| ***C23C 2/18*** | (2006.01) |
| ***C22C 18/00*** | (2006.01) |
| ***C22C 18/04*** | (2006.01) |
| ***C23C 2/04*** | (2006.01) |
| ***C23C 2/12*** | (2006.01) |

(52) U.S. Cl.
CPC ..... *C23C 2/04* (2013.01); *C23C 2/12* (2013.01); *C23C 2/18* (2013.01); *C23C 2/20* (2013.01)

(56) References Cited

U.S. PATENT DOCUMENTS

| | | | | |
|---|---|---|---|---|
| 4,369,211 | A * | 1/1983 | Nitto | C23C 2/26 427/349 |
| 6,713,129 | B2 | 3/2004 | Tanokuchi et al. | |
| 2011/0177253 | A1* | 7/2011 | Oohashi | C23C 2/06 427/432 |
| 2012/0052206 | A1* | 3/2012 | Diez | C23C 2/06 427/331 |
| 2013/0232811 | A1* | 9/2013 | Koga | C23C 2/20 34/241 |

FOREIGN PATENT DOCUMENTS

| | | | |
|---|---|---|---|
| CN | 202164345 | U | 3/2012 |
| CN | 102459684 | A | 5/2012 |
| DE | 4010801 | A1 | 10/1991 |
| EP | 2634284 | A1 | 9/2013 |
| JP | H01287261 | A | 11/1989 |
| JP | H04285146 | A | 10/1992 |
| JP | 2004010987 | A | 1/2004 |
| JP | 2007138208 | A | 6/2007 |
| WO | 2012056935 | A1 | 5/2012 |

* cited by examiner

INSTALLATION FOR HOT DIP COATING A METAL STRIP COMPRISING AN ADJUSTABLE CONFINEMENT BOX

The present invention relates to an installation for hot dip coating a metal strip, comprising a pot containing a melt bath and a wiping system for wiping the coated metal strip after it exits the metal bath. The wiping system allows controlling the quality and thickness of the coating of the metal strip passing through the installation.

BACKGROUND

Steel sheets used for manufacturing bodies-in-white for the automobile industry are generally coated with a zinc-based metal layer for corrosion protection, deposited either by hot-dip coating in a zinc-based liquid bath or by electro-deposition in an electroplating bath containing zinc ions.

In the continuous galvanizing process, known as hot-dip galvanizing process, the continuously moving metal strip is dipped into a bath of molten metal. It is then dragged out of the bath, and a turbulent slot jet is used to wipe the excess metal and control the thickness of the coating.

DE 40 10 801 discloses an installation for hot dip coating a metal strip comprising a pot containing a melt bath and a wiping system for wiping the coated metal strip after it exits the melt bath. The wiping system comprises a confinement box having an upper confinement part which is fixed relative to the pot, and a lower confinement part which can be displaced vertically relative to the pot and to the upper confinement part between a bottom position in which it is partially immersed in the melt bath and a top position in which there exists a free space between the bottom edge of the confinement box and the surface of the melt bath.

Such an installation is not entirely satisfactory. Indeed, the quality of the coating will vary e.g. depending on operating parameters of the line, such as the speed of the line or the wiping pressure, as well as on the format of the metal strip, such as its width or thickness. Therefore, the installation disclosed in DE 40 10 801 cannot be used to achieve satisfactory coatings for all kinds of productions.

BRIEF SUMMARY

An object of the present invention provides an installation which is flexible and can produce a satisfactory coating of the metal strip for various kinds of productions.

The present invention provides an installation for hot dip coating a metal strip. The installation includes means for moving said metal strip along a path, a pot for containing a melt bath and a wiping system comprising at least two nozzles placed on either side of said path downstream the pot. Each nozzle has at least a gas outlet and the nozzles are vertically movable relative to the pot. The wiping system has a box with a lower confinement part for confining an atmosphere around the metal strip upstream of the nozzles, an upper confinement part for confining the atmosphere around the metal strip downstream of the nozzles, first moving means for vertically moving the lower confinement part with respect to the pot and second moving means for vertically moving the upper confinement part with respect to both the pot and the lower confinement part.

The installation according to the invention may also comprise one or more of the following features:

- the upper confinement part is connected with the nozzles so that the vertical movement of the nozzles relative to the pot results in a vertical movement of the upper confinement part of the same amplitude relative to the pot and to the lower confinement part;
- the lower confinement part is vertically movable between a bottom position and a top position, the lower confinement part being intended to be partly immersed in the melt bath in the bottom position;
- the lower confinement part includes two lower plates, one on either side of the path, said lower plates bearing on the pot;
- the first moving means includes jacks connecting the pot to the lower plates;
- the upper confinement part includes two upper plates, one on either side of the path, each upper plate being slidable along the vertical direction relative to a corresponding lower plate located on the same side of the path;
- the box further includes guiding rails located between facing sides of the corresponding lower and upper plates for guiding the movement of the upper plates relative to the lower plates along the vertical direction;
- each upper plate associated with the corresponding lower plate located on the same side of the path of the metal strip forms a longitudinal wall of the box, and the box further includes lateral walls extending between the longitudinal walls for closing the box laterally;
- each lateral wall includes an upper lateral plate connecting the upper plates with each other, a lower lateral plate connecting the lower plates with each other and a V-shaped connection part, extending between the upper lateral plate and the lower lateral plate, and wherein the angle of the V varies depending on the relative movements of the upper and the lower plates;
- the box further includes longitudinal shutters, each longitudinal shutter extending in a plane substantially parallel to the longitudinal walls of the box across a lateral end of a corresponding one of the V-shaped connection parts so as to close this lateral end;
- the wiping system has at least one auxiliary pipe for injecting an inerting gas inside the box downstream of the nozzles;
- the wiping system has at least one auxiliary pipe for injecting an inerting gas inside the box upstream the nozzles;
- the wiping system comprises an oxygen content measurement device for measuring the oxygen content inside the box;
- the upper confinement part is topped by closing caps extending towards the path and delimiting a slit for the passage of the metal strip;
- the nozzles delimit between them a gap intended for the passage of the metal strip, the installation further including an anti-collision device configured for preventing jets of gas blown from the nozzles from meeting in the gap;
- the melt bath includes Zn or Zn based alloy; and
- the melt bath includes Al or Mg.

BRIEF DESCRIPTION OF THE DRAWINGS

The invention will be better understood upon reading the following description given solely by way of example, and with reference to the appended drawings, in which.

DETAILED DESCRIPTION

In the following specification, the expressions "downstream" and "upstream" are to be understood relative to the path of the metal strip.

Figure 1:
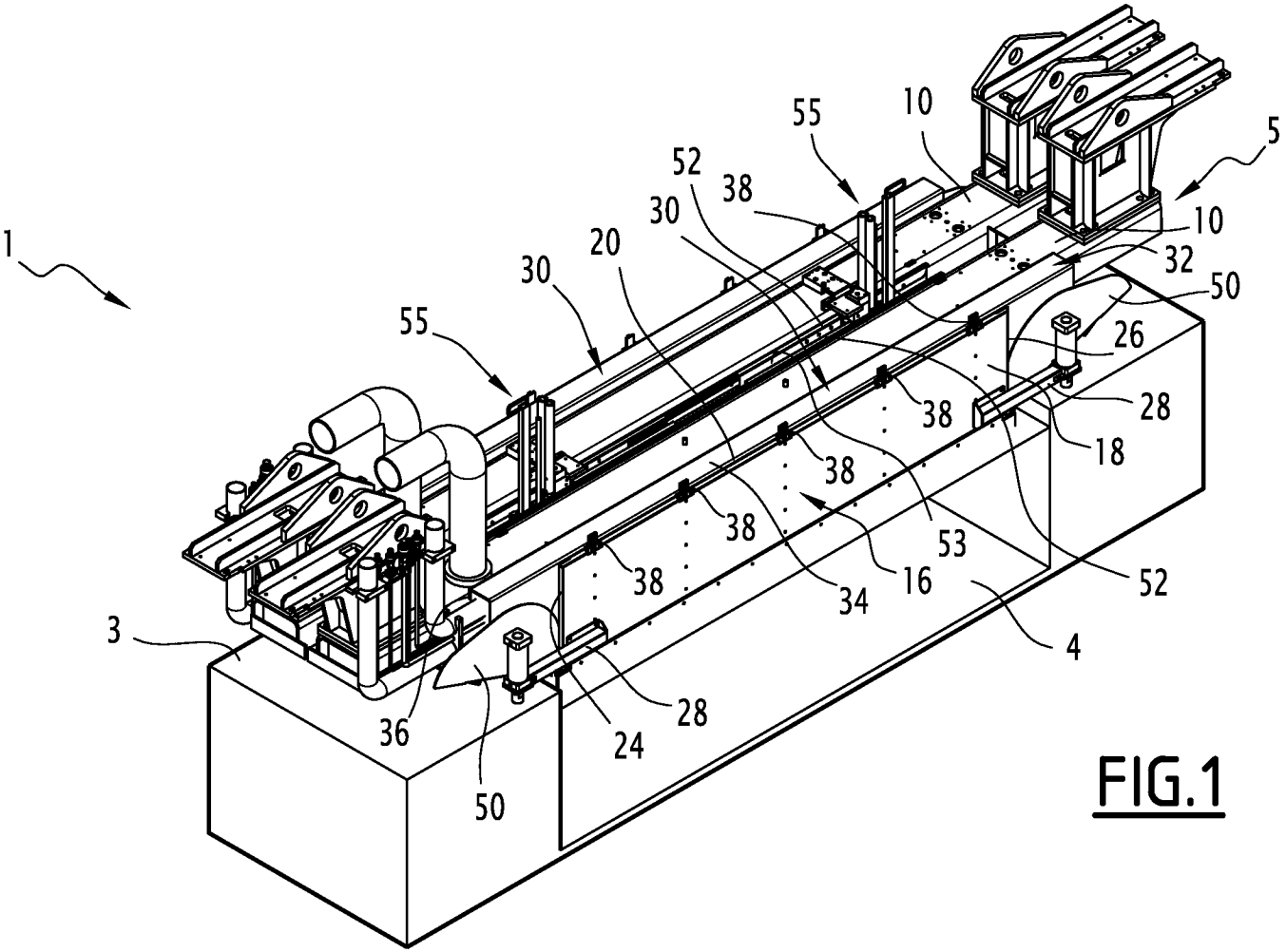
FIG. 1 is a perspective view of the installation for hot dip coating a metal strip according to the present invention.
Figure 2:
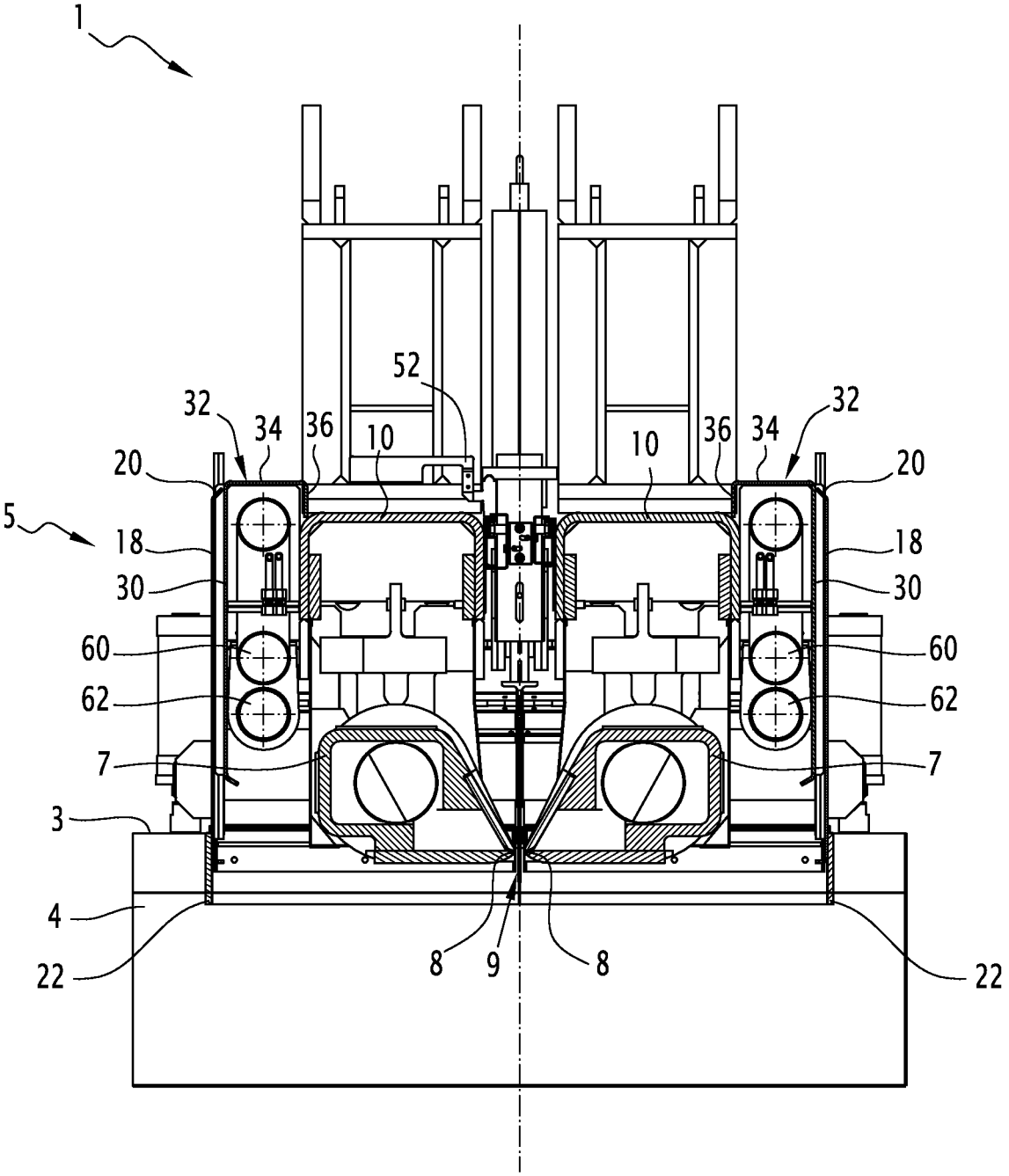
FIG. 2 is a schematic cross-sectional view of the installation of FIG. 1, taken along a plane perpendicular to the longitudinal sides of the installation, the lower confinement part being partly immersed in the melt bath.
Figure 3:
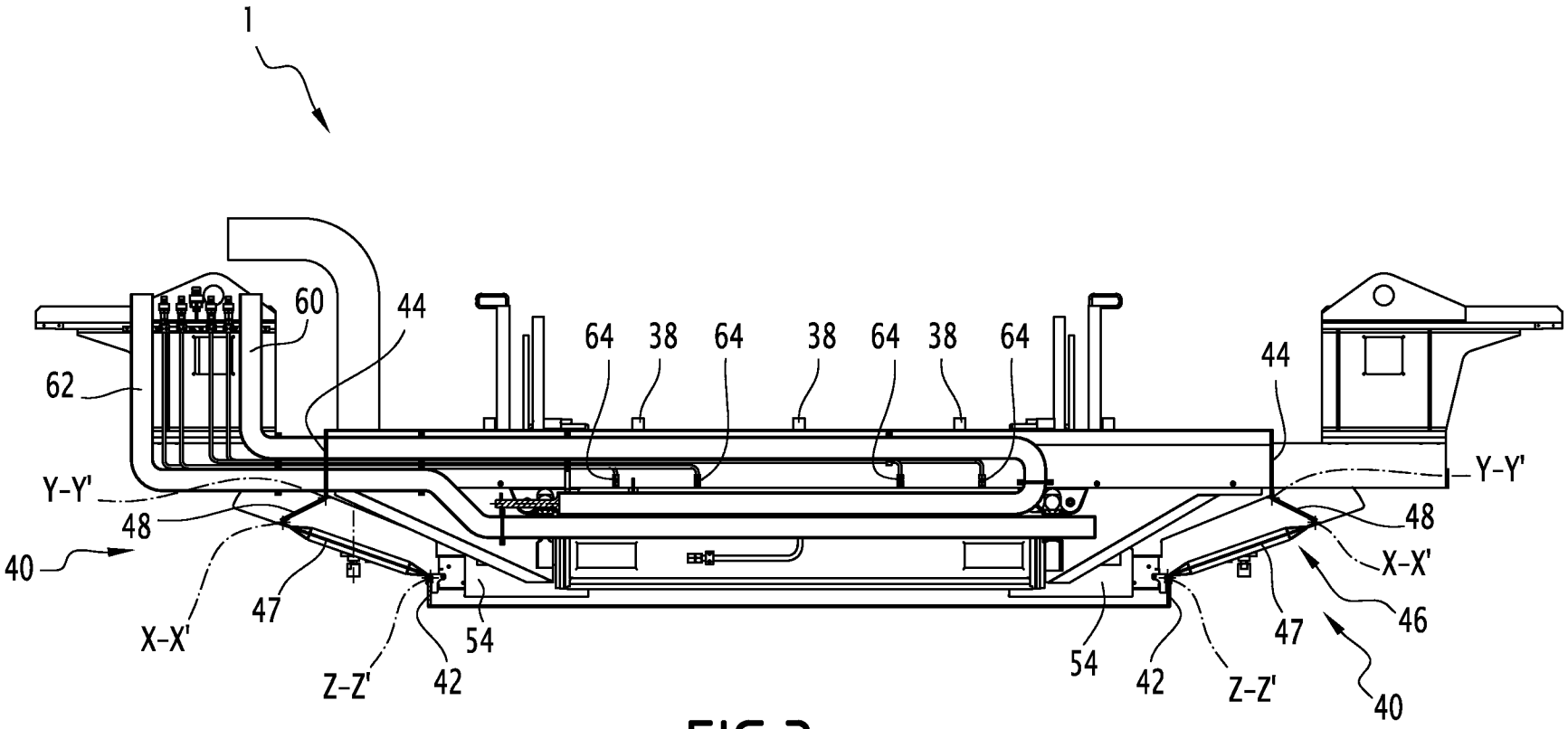
FIG. 3 is a schematic cross-sectional view of the installation, taken along a plane parallel to the longitudinal sides of the installation.

An installation 1 for hot dip coating a metal strip according to the present invention is shown in FIG. 1.

The installation 1 comprises a pot 3 or reservoir containing a melt bath 4.

The melt bath 4 contains a molten metal intended fir coating the metal strip. For example, the melt bath 4 comprises zinc (Zn) or a zinc (Zn) based alloy. The melt bath 4 may further contain aluminum (Al) and/or magnesium (Mg).

The installation 1 further comprises means for moving the metal strip along a path, for example, a conveyor. These strip moving means are configured for moving the metal strip through the melt bath 4 in order to coat the metal strip with the molten metal contained in the melt bath 4. They are also configured for dragging the metal strip vertically out of the melt bath 4 and for moving it vertically through a wiping system 5 of the installation 1.

When the metal strip moves through the wiping system 5, the strip extends substantially in a plane which will be referred to as longitudinal plane in the following. This longitudinal plane e.g. contains the vertical direction. The direction of the width of the metal strip is referred to as the longitudinal direction. The longitudinal direction is e.g. substantially perpendicular to the vertical direction.

The strip moving means are conventional.

The wiping system 5 is intended for wiping the metal strip exiting the melt bath 4 in order to remove excess molten metal and to adjust the thickness of the coating to a desired thickness.

The wiping system 5 comprises at least two nozzles 7 placed on either side of the path of the metal strip downstream of the pot 3. More particularly, the nozzles 7 delimit between them a gap 9 for the passage of the metal strip. The nozzles 7 are arranged on either side of this gap 9 so as to blow jets of gas onto a respective side of the metal strip in order to wipe away the excess molten metal. The gap 9 for the passage of the metal strip extends parallel to the strip plane. The nozzles 7 can be moved horizontally so as to set the width of the gap 9.

Each nozzle 7 comprises at least one gas outlet 8 through which the wiping gas is blown onto the respective side of the metal strip. This gas outlet 8 is for example formed by a slit which extends substantially parallel to the longitudinal direction along the entire length of the nozzle 7. The jets of gas blown from the slit-shaped gas outlets 8 form a curtain through which the metal strip passes along a, e.g. vertical path. The jets of gas from the nozzles 7 impinge on the metal strip along a wiping line. The curtain extends in a plane that is substantially perpendicular to the plane of the strip, e.g. substantially horizontal. The wiping line extends along the longitudinal direction, e.g. substantially horizontally.

Each nozzle 7 is connected to an adequate wiping gas source for providing the gas which is to be blown onto the metal strip. The wiping gas is for example nitrogen ($N_2$) or any other adequate gas.

Each nozzle 7 is supported by a support beam 10 which is, in this example, located above each nozzle 7. The support beams 10 extend on either side of the path of the metal strip. The support beams 10 delimit between them a gap for the passage of the metal strip as it is moved along its path. This gap extends substantially parallel to the longitudinal direction.

The nozzles 7 are movable vertically relative to the pot 3 through nozzle displacement means. More particularly, the support beams 10 are movable vertically relative to the pot 3 and cause a corresponding vertical displacement of the nozzles 7 which are attached to the support beams 10.

The nozzles 7 are connected to the support beams 10 so as to follow any displacement of the support beams 10 along the vertical direction. Advantageously, each nozzle 7 is rigidly connected to the support beam 10 by which it is supported. However, in some specific process configurations, the strip plane is not completely vertical but has a slight inclination relative to the vertical direction, in particular of less than 5°. In such cases, each nozzle 7 will be moved so that the virtual line joining both nozzles 7 crosses the strip plane perpendicularly.

Advantageously, the length of the nozzles 7 is greater than the width of conventional metal strips. This feature allows wiping metal strips of different widths with the same wiping system 5. Therefore, in use, there are areas, at the edges of the gap 9 between the nozzles 7, where the nozzles 7 face each other without interposition of the metal strip.

The wiping system 5 further comprises a box 16 for confining an atmosphere around the metal strip in the wiping area. The box 16 surrounds the wiping area. It prevents the air from outside the box 16 from entering the box 16.

Advantageously, the box 16 is symmetrical relative to the path of the metal strip. It is symmetrical relative to the plane along which the metal strip extends when it passes through the wiping system 5.

The box 16 comprises a lower confinement part for confining the atmosphere around the metal strip upstream of the nozzles 7 and an upper confinement part for confining the atmosphere around the metal strip downstream of the nozzles 7.

The wiping system 5 further comprises first moving means for moving the lower confinement part vertically with respect to the pot 3, and second, moving means for moving the upper confinement part vertically with respect to the lower confinement part and to the pot 3.

The first moving means are configured for moving the lower confinement part relative to the pot 3 between a bottom position, in which the lower confinement part is at least partially immersed in the melt bath 4, and a top position, in which there exists e.g. a space between the lower confinement part and the surface of the melt bath 4. In the example shown, the first moving means also support the lower confinement part relative to the pot 3.

The second moving means are configured for moving the upper confinement part between a bottom position relative to the pot 3 and a top position relative to the pot 3.

The vertical movement of the upper confinement part is independent of the vertical movement of the lower confinement part.

In particular, the vertical movement of the upper confinement part relative to the pot 3 through the second moving means does not result in a vertical movement of the lower confinement part relative to the pot 3.

In particular, the vertical movement of the lower confinement part relative to the pot 3 through the first moving means does not result in a vertical movement of the upper confinement part relative to the pot 3.

More particularly, in the example shown on FIG. 1, the lower confinement part comprises two lower plates 18, one on either side of the path of the metal strip. The lower plates 18 bear on the pot 3. They are parallel to each other. They extend substantially vertically and parallel to the longitudinal direction.

Each lower plate 18 comprises an upper longitudinal edge 20 and a lower longitudinal edge 22 extending along the longitudinal direction, as well as two lateral edges 24, 26, extending perpendicular to the upper and lower longitudinal edges 20, 22 between these two longitudinal edges 20, 22.

The first moving means are configured for moving the lower plates 18 relative to the pot 3 upwards and/or downwards along a vertical direction.

In their bottom position, the lower plates 18 are at least partially immersed in the melt bath 4. The part of the lower plate 18 which is immersed in the melt bath 4 in the bottom position is designed to be able to resist the aggressive environment of the melt bath 4. It is for example thicker than the rest of the lower plate 18.

In their top position, the lower plates 18 extend entirely above the surface of the melt bath 4. The lower longitudinal edges 22 of the lower plates 18 extend at a non-null distance from the surface of the melt bath 4. A free space exists between the lower longitudinal edges 22 of the lower plates 18 and the surface of the melt bath 4.

In the example shown on FIG. 1, the first moving means comprise, jacks 28 connecting the lower plates 18 to the pot 3. The jacks 28 are configured for moving the lower plates 18 vertically between their bottom and their top position. The jacks 28 also hold the lower plates 18 in the desired position relative to the pot 3. The lower plates 18 bear on the pot 3 by means of the jacks 28. The jacks 28 may be controlled manually or automatically as needed.

In the example shown, the wiping system 5 comprises one jack 28 at each lateral edge 24, 26 of the lower plates 18. The wiping system 5 may however comprise any number of jacks 28, as required.

Alternatively, the first moving means may comprise any mechanical means adapted for vertically moving the lower plates 18 relative to the pot 3, and, optionally for holding the lower plates 18 at the desired height relative to the pot 3.

The lower plates 18 extend at least partially upstream of the nozzles 7, i.e. below the nozzles 7. More particularly, they extend at least partially upstream of the wiping line defined by the gas outlets 8 on either side of the path of the metal strip. Therefore, the lower plates 18 confine the atmosphere around the metal strip upstream of the nozzles 7.

In the example shown, the lower plates 18 also extend downstream of the nozzles 7.

The upper confinement part comprises two upper plates 30, one on either side of the path of the metal strip. They are substantially parallel to one another. The upper plates 30 extend along the longitudinal direction. They extend substantially vertically.

The upper plates 30 extend at least partially downstream of the nozzles 7. Therefore they confine the atmosphere around the metal strip in the wiping area downstream of the nozzles 7.

The upper plates 30 are connected with the nozzles 7 in such a way that a vertical movement of the nozzles 7 relative to the pot 3 of a given amplitude results in a vertical movement of the upper confinement part 18, in particular of the upper plates 30, of the same amplitude relative to the pot 3. More particularly, each upper plate 30 is rigidly associated with a corresponding support beam 10 located on the same side of the path of the metal strip. Thus, any vertical displacement of the support beam 10 results in a corresponding vertical displacement of the upper plate 30 associated with the support beam 10.

Advantageously, the upper plates 30 are removably connected to the nozzles 7. The upper plates 30 can be removed from the nozzles 7, and more particularly from the support beams 10, without damaging their connection parts. The upper plates 30 are for example screwed to the support beams 10.

In the example shown, an upper longitudinal edge 32 of the upper plate 30 is connected to the adjacent support beam 10. More precisely, in the example shown on the figures, each upper plate 30 has an upper longitudinal edge 32 having the shape of an inverted U. It comprises a substantially horizontal web 34 and an inner flange 36, which is substantially parallel to the upper plate 30. The inner flange 36 is attached to the corresponding support beam 10 through attachment means, such as for example rivets or screws.

Any movement of the nozzles 7 along the vertical direction results in a corresponding vertical displacement of the upper plates 30 relative to the pot 3. The second moving means therefore comprise the means for vertically displacing the nozzles 7.

More particularly, each upper plate 30 extends substantially parallel to an adjacent lower plate 18 located on the same side of the path of the strip. The upper plate 30 and the adjacent lower plate 18 form a longitudinal wall of the box 16.

The upper confinement part is connected to the lower confinement part so as to be slidable along the vertical direction relative to the lower confinement part.

More particularly, each upper plate 30 is slidably connected to an adjacent lower plate 18 located on the same side of the path of the metal strip. More particularly, the second moving means comprise guiding means for guiding the movement of the upper plate 30 relative to the lower plate 18 along the vertical direction. In the example shown, these guiding means comprise a plurality of guiding rails 38 arranged between facing sides of the adjacent upper and lower plates 30, 18. The guiding rails 38 extend substantially vertically. They are spaced apart along the longitudinal direction.

The upper plates 30 slide along the lower plates 18 when the second moving means move the upper plates 30 vertically relative to the pot 3, i.e. when the nozzles 7 are moved vertically relative to the pot 3. The upper plates 30 also slide relative to the lower plates 18 when the lower plates 18 are moved vertically relative to the pot 3 by the first moving means.

The height of the box 16, measured between the lower longitudinal edge 22 of the lower plate 18 and the upper longitudinal edge 32 of the adjacent upper plate 30, is thus adjustable. It automatically adjusts itself to a new distance between the nozzles 7 and the pot 3 through the sliding movement of the upper plate 30 relative to the lower plate 18.

The box 16 further comprises two lateral walls 40 extending between the longitudinal walls of the box 16. The lateral walls 40 extend substantially perpendicular to the longitudinal direction, and in particular perpendicular to the longitudinal walls of the box 16. Advantageously, the lateral walls 40 extend over substantially the entire height of the box 16.

The configuration of the lateral walls 40 automatically adapts itself to the current height of the box 16, i.e. to the relative positions of the lower and upper plates 18, 30.

The lateral walls 40 extend over the entire height of the box 16 regardless of the relative positions of the lower and upper plates 18, 30.

Each lateral wall 40 comprises a lower lateral plate 42 which connects the lateral edges 24 or 26 of the opposite lower plates 18 to each other, an upper lateral plate 44 which connects the lateral edges of the opposite upper plates 30 to each other and a connection part 46 connecting the lower lateral plate 42 to the upper lateral plate 44.

In the example shown, the lower lateral plate 42 extends substantially perpendicular to the lower plates 18 between the two lower plates 18. It is rigidly attached to the lower plates 18. It is movable along the vertical direction together with the lower plates 18 between a bottom position, in which it is for example partially immersed in the melt bath and a top position, in which a lower edge of the lateral plate 42 for example extends at a distance from the surface of the melt bath 4. For example, the lower edge of the lateral plate 42 extends at the same distance of the surface of the melt bath 4 as the lower longitudinal edges 22 of the lower plates 18.

The lower lateral plate 42 confines the atmosphere around the metal strip in the wiping area upstream of the nozzles 7 by preventing a lateral air entrance in this area. In this example, it forms a part of the lower confinement part of the box 16.

The upper lateral plate 44 extends substantially perpendicular to the upper plates 30 between the two upper plates 30. It is rigidly attached to the upper plates 30. It is integral with the upper plates 30 and follows their vertical displacements.

The upper lateral plate 44 confines the atmosphere in the wiping area around the metal strip downstream of the nozzles 7 by preventing a lateral air entrance in this area. It forms a part of the upper confinement part of the box 16.

The connection part 46 is V-shaped. The V opens towards the inside of the box 16.

The connection part 46 comprises a lower connection plate 47 and an upper connection plate 48, each forming one of the legs of the V.

The angle between the legs of the V varies depending on the relative position of the lower and upper lateral plates 42, 44, and thus on the relative position of the upper and lower confinement parts.

For example, when the upper confinement part moves upwards relative to the lower confinement part, the angle formed between the legs of the V increases. When the upper confinement part moves downwards relative to the lower confinement part, the angle formed between the legs of the V decreases.

The connection part 46 acts as a bellows to accommodate the changes in the relative positions of the lower and upper lateral plates 42, 44 while maintaining a good tightness of the lateral wall 40, in particular between the lower and upper lateral plates 42, 44.

The upper and lower connection plates 47, 48 are rotatably connected to one another, e.g. through a hinge, around a first axis of rotation X-X'. The first axis of rotation X-X' is e.g. substantially horizontal and perpendicular to the longitudinal walls of the box 16.

In the example shown, the connection part 46 is further rotatably connected to the upper lateral plate 44, e.g. through a hinge, around a second axis of rotation Y-Y'. The second axis of rotation Y-Y' is e.g. horizontal and perpendicular to the upper plates 30.

The connection part 46 is further rotatably connected to the lower lateral plate 42 around a third axis of rotation Z-Z', e.g. through a hinge. The third axis of rotation Z-Z' is e.g. horizontal and perpendicular to the lower plates 18.

The first, second and third axes of rotation are substantially parallel to one another.

The box 16 further comprises longitudinal shutters 50. In the example shown, each longitudinal shutter 50 is attached to a lateral end of a lateral wall 40 of the box 16. The lateral ends of the lateral walls 40 are the ends of the lateral walls 40 taken along the direction perpendicular to the longitudinal walls of the box 16, i.e. the ends of the lateral walls 40 adjacent to the longitudinal walls of the box 16.

More specifically, each longitudinal shutter 50 is rigidly attached to the connection part 46, and more particularly, to the lower connection plate 47. Therefore, the longitudinal shutter 50 rotates around the third axis of rotation Z-Z' relative to the lower and upper plates 18, 30 together with the connection plate 47. In the example shown, the box 16 comprises one longitudinal shutter 50 at each corner of the box 16.

In the example shown, each longitudinal shutter 50 is formed by a plate. This plate e.g. has a contour including a rectilinear portion connected to the connection plate 47 and a curved free edge. The curved free edge is convex. The curved free edge is designed so as to allow the rotation of the longitudinal shutter 50 around the third axis of rotation Z-Z' relative to the lower and upper plates 18, 30 without being impeded by the guiding rails 38.

The longitudinal shutters 50 seal the V-shaped openings at the lateral ends of the lateral walls 40 by extending across these V-shaped openings in a plane perpendicular to the corresponding lateral wall 40.

The longitudinal shutters 50 extend in a plane parallel to the longitudinal walls of the box 16. They extend at least partially between the adjacent lower and upper plates 18, 30 at the lateral edges thereof. Therefore, the longitudinal shutters 50 seal the space existing between the adjacent lower and upper plates 18, 30 at the lateral edges thereof and prevent outside air from entering into the box 16 through this space. Therefore, they help improving the tightness of the box 16 in these areas.

The longitudinal shutters 50 automatically rotate around an axis perpendicular to the longitudinal walls of the box 16, more particularly about the third axis of rotation Z-Z', relative to the lower and upper plates 18, 30 when the relative positions of these plates 18, 30 vary. When the longitudinal shutters 50 rotate relative to the lower and upper plates 18, 30, the portion of the shutter 50 extending between the adjacent upper and lower plates 18, 30 varies.

The longitudinal shutters 50 rotate further into the space between the adjacent lower and upper plates 18, 30 as the height of the box 16 increases. On the contrary, they rotate partially out of the space between the adjacent lower and upper plates 18, 30 as the height of the confinement box 16 decreases. Therefore, the portion of the longitudinal shutters 50 extending between the adjacent lower and upper plates 18, 30 decreases as the height of the box 16 decreases.

The upper confinement part is topped by closing caps 52 which close the box 16 at its top. The closing caps 52 delimit between them a slit 53 through which the metal strip leaves the box 16. This slit 53 extends along the longitudinal direction.

In the example shown on the figures, the box 16 comprises two closing caps 52, located on either side of the path of the metal strip and extending towards it. More particularly, the closing caps 52 extend in the gap formed between the support beams 10 and decrease the width of this gap. The width of the slit 53 delimited between the closing caps 52 is smaller than the width of the gap formed between the support beams 10. Thus, the closing caps 52 seal the top of the box 16 around the metal strip and improve the tightness of the box 16 in the area where the metal strip leaves the confinement box 16.

The wiping system 5 may optionally comprise a device for preventing an over-coating of the edges of the strip. Over-coating of the edges of the strip means that the coating is thicker at the edges of the strip than in the center of the strip.

More particularly, the device for preventing an over-coating of the edges of the metal strip comprises an anti-collision device configured for preventing the jets of gas blown from the nozzles 7 from meeting each other in the gap 9, in particular at the edges of the gap 9 where, in use, due to the width of the metal strip, no metal strip will be interposed between the nozzles 7. Thus, in these areas, the jets of gas blown from the nozzles 7 will interact with the anti-collision device extending between them, rather than meeting each other in the gap 9.

Preventing the jets of gas blown from the opposite nozzles 7 from meeting is advantageous. Indeed, it prevents the over-coating of the edges of the metal strip which may otherwise have resulted from the perturbation of the flow of gas due to such a meeting.

A second advantageous effect is an anti-noise effect, i.e. the prevention of the occurrence of sound vibrations of large amplitude which might otherwise have resulted from the meeting of the jets of gas in the gap 9.

Such an anti-collision device may include an electromagnetic system generating a magnetic field which interacts with the coating metal. It may also be a mechanical device. In the example shown in the figures, the anti-collision device comprises two baffles 54. Each baffle 54 is formed by a metal plate extending in the gap 9 between the opposite nozzles 7 in the areas where, due to the width of the metal strip, the nozzles 7 will face each other without interposition of a metal strip, i.e. in particular at the edges of the gap 9, taken along the longitudinal direction.

The anti-collision device extends in the confinement box 16. In particular, it is entirely comprised in the confinement box 16.

The anti-collision device is advantageously displaceable in the gap 9 relative to the nozzles 7. This displacement can be made in order to align the anti-collision device with the strip plane, by moving the anti-collision device perpendicularly to the strip plane. Moreover, the device can also be moved along a direction parallel to the strip plane. For this purpose, the wiping system 5 further comprises an actuation device for displacing the anti-collision device. The actuation device is controllable from outside the confinement box 16. In particular, in the example shown in the figures, the actuation device extends at least partially outside of the confinement box 16 so as to be reachable from outside the confinement box 16 in order to displace the anti-collision device. More particularly, the actuation device is connected to the anti-collision device comprised in the confinement box 16 and extends through the slit 53 delimited between the closing caps 52.

In the example shown in the figures, the actuation device comprises at least one rod 55 for displacing each baffle 54. Each rod 55 is integrally attached to the corresponding baffle 52. It extends upwards from the baffle 54 through the slit 53 delimited between the closing caps 52. It extends at least partially outside of the confinement box 16.

Advantageously, the rods 55 are movable along the longitudinal direction relative to the nozzles 7. The rods 55 may be fixed relative to the nozzles 7 along the vertical direction.

For example, the rods 55 may be slidably mounted in rails provided on the support beams 10, and which are substantially parallel to the longitudinal direction. These rails allow a relative movement along the longitudinal direction between the support beams 10 and the rods 55, and thus the baffles 54 which are integral with the rods 55. The rods 55 however follow the movement of the support beams 10 and thus of the nozzles 7 along the vertical direction.

Providing a wiping system comprising a confinement box 16 and an anti-collision device is advantageous. Indeed, although the system is very well confined through the confinement box 16, it is still possible to provide an anti-collision device for preventing coating defects such as edge over-coating and to displace this anti-collision device as needed inside of the confinement box 16.

Optionally, the wiping system 5 further comprises at least a first auxiliary pipe 60 for injecting an inerting gas into the box 16 downstream of the nozzles 7. In particular, the wiping system 5 comprises at least one first auxiliary pipe 60 on either side of the path of the metal strip.

Optionally, the wiping system further comprises at least a second auxiliary pipe 62 for injecting an inerting gas into the box 16 upstream of the nozzles 7. In particular, the wiping system 5 comprises at least one second auxiliary pipe 62 on either side of the path of the metal strip.

The lateral walls 40, and more particularly the upper lateral plates 44, may comprise openings through which the first and/or second auxiliary pipes 60, 62 are inserted into the box 16 in an airtight manner.

The pipes 60, 62 may for example extend substantially horizontally inside the box 16 along the longitudinal sides of the box 16. They comprise gas outlets for blowing the inerting gas into the box 16. Each gas outlet preferably extends along the entire length of the wiping nozzles 7 in order to uniformly distribute the inerting gas in the box 16. Advantageously, the gas outlets of the pipes 60, 62 are formed by at least one, and advantageously a plurality of longitudinally extending slits. The pipes 60, 62 are connected to a source of inerting gas. The inerting gas is for example nitrogen ($N_2$).

For band widths above 1400 mm, the length of the pipes 60, 62 may be reduced on either side of the path of the metal strip. In this case, each pipe 60, 62 comprises one gas outlet for distributing the inerting gas located in the box 16 at the end of the pipe 60, 62. The gas outlets of the first and second auxiliary pipes 60, 62 open out facing a respective lateral edge of the metal strip. Therefore, the inerting gas is not distributed along the entire length of the wiping nozzles 7.

As an example, the first auxiliary pipes 60 have their gas outlets formed on the side so that the gas is blown out of these pipes horizontally in the area of the box 16 downstream of the nozzles 7.

For example, the second auxiliary pipes 62 have their gas outlets formed along the bottom of the pipes 62 so that the inerting gas is blown out of these pipes 62 vertically in an upstream direction into the area of the box 16 upstream of the nozzles 7. The inerting gas from the second auxiliary pipes 62 is also blown into the area of the box 16 located between the upper and/or lower plates 18, 30 and the nozzles 7.

The auxiliary pipes 60, 62 can be used for injecting an inerting gas into the box 16 so as to create an overpressure in the box 16 preventing outside air from entering the box 16. Therefore, inerting gas injection contributes to improving the tightness of the box 16.

The wiping system 5 may also comprise a system for recirculating the inerting gas from the box 16. This system is configured for removing the inerting gas from the box 16 for example by means of a pump and for reinjecting it into the box 16 through the first and/or second auxiliary pipes 60, 62 and/or through the nozzles 7. Such a system is conventional and is not illustrated on the figures. It may in particular be used when the box 16 is in an entirely closed configuration, in which the lower end of the confinement box 16 is immersed in the melt bath and substantially no gas can escape from the box 16 through its lower end.

Finally, the wiping system 5 may comprise an oxygen content measurement device for measuring the content of oxygen inside the box 16, in particular close to the metal strip. This measurement device comprises a plurality of pipes 64 connected to one or several oxygen probes, configured for measuring the oxygen content at different locations inside the box 16. For example, the device comprises a plurality of oxygen probes on either side of the path of the metal strip, the oxygen probes being configured for measuring the oxygen content close to the metal strip at different locations along the width of the metal strip.

The confinement box 16 of the installation 1 according to the invention can produce a satisfactory coating of the metal strip for various kinds of productions.

When switching from one kind of coated metal strip production to another, e.g. when passing from one metal strip thickness to another or from one coating thickness to another, the line speed may change.

With the installation 1 according to the invention, the same quality of coating can be obtained regardless of the format (width, thickness) and of the speed of the metal strip passing through the wiping system 5. Indeed, when the speed of the strip is increased, e.g. in case of producing a thinner metal strip for a given coating thickness, it is usually necessary to increase the wiping pressure accordingly. This increased pressure may result in projections of coating metal from the metal strip onto the wiping nozzles 7, which may partially obstruct the gas outlets 8 of the nozzles 7. This in turn may lead to an unsatisfactory quality of the coating since the coating would not be wiped in the areas facing the obstructed regions of the gas outlets 8. In the installation according to the invention, this can be limited by increasing the distance between the nozzles 7 and the bath 4 so as to reduce reprojections.

Furthermore, when the installation 1 comprises an anti-collision device, for example the baffles 54, this anti-collision device contributes to obtaining a good level of coating quality by reducing defects such as in particular edge over-coating.

Moreover, the quality of the coating stays satisfactory although the bath-to-nozzle distance is increased since the confinement box 16 adapts itself to changes in the bath-to-nozzle distance, thus ensuring an adequate confinement regardless of the bath-to-nozzle distance, and preventing the oxidation of the coating around the wiping area. This is notably due to the fact that the upper confinement part is movable relative to the pot 3 along a vertical direction. This adaptation of the box 16 is further automatic, since the upper confinement part is connected to the nozzles 7 so as to follow their vertical displacement.

The installation according to the invention is further particularly versatile. Indeed, the box 16 can be adapted to any existing nozzle system regardless of the distance between the nozzles 7 and the surface of the bath 4 since it comprises an upper and a lower confinement part which are movable relative to one another and relative to the pot 3.

Moreover, the distance between the lower end of the box 16 and the pot 3 can be very easily varied simply by moving the lower confinement part relative to the pot 3. It is therefore very easy to switch from an open box configuration, in which a rather large space exists between the surface of the melt bath 4 and the lower end of the box 16 to an entirely sealed configuration, where the lower end of the box 16 is immersed in the melt bath 4. This feature therefore allows for an easy adaptation of the confinement box 16 to the wiping conditions or to varying melt bath compositions. For example, it allows partially immersing the lower confinement part into the melt bath 4 if particularly high gas tightness is desired. Alternately, it allows providing a gap between the melt bath surface and the lower confinement part if it is desired to have access to the surface of the melt bath, for example for cleaning purposes.

Moreover, the fact that lateral walls 40 and the longitudinal shutters 50 move in response to vertical nozzle displacements and/or changes in the box 16 to pot 3 distance, also contributes to the adaptation of the shape of the box 16 to variations in the nozzle 7 to pot 3 distance or in the box 16 to pot 3 distance.

The wiping system 5 according to the invention is further very easy to exploit and to maintain. This is notably due to the possibility to move the lower confinement part relative to the pot 3 or to the nozzles 7. Indeed, it is thus possible to clean the melt bath surface or the nozzles 7 when needed, simply by moving the lower confinement part vertically upwards.

Moreover, when the box 16 is not made in one piece with the nozzles 7 and support beams 10, it offers the additional advantage that it can be easily dismounted from the nozzles 7 for example for maintenance of the components of the nozzle system.

What is claimed is:

1. An installation for hot dip coating a metal strip comprising:

a conveyor moving a metal strip along a path;

a pot for containing a melt bath; and a wiping system comprising:

at least two nozzles placed on either side of the path downstream of the pot, each nozzle having at least one gas outlet, the nozzles being vertically movable relative to the pot;

a box with a lower confinement part for confining an atmosphere around the metal strip upstream of the nozzles and an upper confinement part for confining the atmosphere around the metal strip downstream of the nozzles;

wherein the lower confinement part is movable in a vertical direction with respect to the pot;

the upper confinement part is movable in a vertical direction with respect to both the pot and the lower confinement part; wherein the upper confinement part comprises two upper plates, one on either side of the path;

the lower confinement part comprises two lower plates, one on either side of the path;

the upper plates extend parallel to the vertical direction;

the upper plates and the lower plates are movable relative to each other;

each of the upper plates being arranged to telescope above a corresponding one of the lower plates.

2. The installation according to claim 1, wherein the upper confinement part is connected with the nozzles so that a vertical movement of the nozzles relative to the pot results in a vertical movement of the upper confinement part of the same amplitude relative to the pot and to the lower confinement part.

3. The installation according to claim 2, wherein the lower confinement part is vertically movable between a bottom position and a top position, the lower confinement part being partly immersed in the melt bath in the bottom position.

4. The installation according to claim 1, wherein the two lower plates bear on the pot.

5. The installation according to claim 4, wherein the box comprises jacks connecting the pot to the lower plates.

6. The installation according to claim 4, wherein each of the two upper plates is slidable along the vertical direction relative to corresponding lower plates located on a same side of the path.

7. The installation according to claim 6, wherein the box further comprises guiding rails located between facing sides of corresponding lower and upper plates for guiding the movement of the upper plates relative to the lower plates along the vertical direction.

8. The installation according to claim 6, wherein the two upper plates associated with corresponding lower plates located on a same side of the path of the metal strip form a longitudinal wall of the box, and the box further comprises lateral walls extending between the longitudinal walls for closing the box laterally.

9. The installation according to claim 8, wherein each lateral wall comprises an upper lateral plate connecting the upper plates with each other, a lower lateral plate connecting the lower plates with each other and a V-shaped connection part, extending between the upper lateral plate and the lower lateral plate, and wherein the angle of the V varies depending on the relative movements of the upper and the lower plates.

10. The installation according to claim 9, wherein the box further comprises longitudinal shutters, each longitudinal shutter extending in a plane substantially parallel to the longitudinal walls of the box across a lateral end of a corresponding one of the V-shaped connection parts so as to close the lateral end.

11. The installation according to claim 1, wherein the wiping system has at least one auxiliary pipe for injecting an inerting gas inside the box downstream of the nozzles.

12. The installation according to claim 1, wherein the wiping system has at least one auxiliary pipe for injecting an inerting gas inside the box upstream of the nozzles.

13. The installation according to claim 1, wherein the upper confinement part is topped by closing caps extending towards the path and delimiting a slit for passage of the metal strip.

14. The installation according to claim 13, wherein the nozzles delimit between them a gap intended for the passage of the metal strip, and jets of gas are prevented from meeting each other in the gap.

15. The installation according to claim 1, wherein the melt bath comprises Zn or Zn based alloy.

16. The installation according to claim 15, wherein the melt bath comprises Al or Mg.

17. The installation according to claim 1, wherein the upper confinement part is slidable along the vertical direction relative to the lower confinement part.

18. An installation for hot dip coating a metal strip comprising:

a conveyor moving a metal strip along a path;

a pot for containing a melt bath; and a wiping system comprising:

at least two nozzles placed on either side of the path downstream of the pot, each nozzle having at least one gas outlet, the nozzles being vertically movable relative to the pot;

a box with a lower confinement part for confining an atmosphere around the metal strip upstream of the nozzles and an upper confinement part for confining the atmosphere around the metal strip downstream of the nozzles;

wherein the lower confinement part is movable in a vertical direction with respect to the pot;

the lower confinement part further comprises inner plates;

the upper confinement part is movable in a vertical direction with respect to both the pot and the lower confinement part;

the upper confinement part further comprises outer plates;

the outer plates at least partially delimit an outer contour of the box and are movable relative to the pot and the lower confinement part; and each of the outer plates being arranged to telescope above a corresponding one of the inner plates.

19. The installation of claim 18, wherein the outer plates are movable such that a movement of the upper confinement part relative to the pot and to the lower confinement part comprises a movement of the outer plates relative to the pot and to the lower confinement part.

20. The installation according to claim 18, wherein the outer plates extend parallel to the vertical direction.

21. The installation of claim 18, wherein the outer plates are substantially parallel to one another.

* * * * *